United States Patent [19]

Deshpande

[11] Patent Number: 4,947,193

[45] Date of Patent: Aug. 7, 1990

[54] THERMAL INK JET PRINTHEAD WITH IMPROVED HEATING ELEMENTS

[75] Inventor: Narayan V. Deshpande, Penfield, N.Y.

[73] Assignee: Xerox Corporation, Stamford, Conn.

[21] Appl. No.: 346,056

[22] Filed: May 1, 1989

[51] Int. Cl.[5] ..... B41V 2/05

[52] U.S. Cl. ..... 346/140 R; 338/333

[58] Field of Search ..... 346/140, 76 PH; 219/216; 338/308, 309, 333

[56] References Cited

U.S. PATENT DOCUMENTS

| | | | |
|---|---|---|---|
| Re. 32,572 | 1/1988 | Hawkins et al. | 156/626 |
| 4,204,107 | 5/1980 | Ohkubo | 219/216 |
| 4,339,762 | 7/1982 | Shirato et al. | 346/140 R |
| 4,345,262 | 8/1982 | Shirato | 346/140 |
| 4,370,668 | 1/1983 | Hara et al. | 346/140 R |
| 4,514,741 | 4/1985 | Meyer | 346/140 |
| 4,532,530 | 7/1985 | Hawkins | 346/140 R |
| 4,567,493 | 1/1986 | Ikeda et al. | 346/140 R |
| 4,638,337 | 1/1987 | Torpey et al. | 346/140 R |
| 4,679,056 | 7/1987 | Kobayashi | 346/76 PH |
| 4,686,544 | 8/1987 | Ikeda et al. | 346/140 R |
| 4,725,859 | 2/1988 | Shibata et al. | 346/140 R |
| 4,831,391 | 5/1989 | Asai | 346/140 |

*Primary Examiner*—Joseph W. Hartary
*Attorney, Agent, or Firm*—Robert A. Chittum

[57] ABSTRACT

An improved thermal ink jet printhead has a plurality of heating elements in ink channels selectively addressable by electrical signals to eject ink droplets from nozzles located at one end of the ink channels on demand. The heating elements each have a passivated layer of resistive material that has non-uniform sheet resistance in a direction transverse to the direction of ink in the channels. The non-uniform sheet resistance provides a substantially uniform temperature across the width of the resistive layer, so that the power required to eject a droplet is reduced and the droplet size dependence on electrical signal energy is eliminated.

7 Claims, 5 Drawing Sheets

THERMAL INK JET PRINTHEAD WITH IMPROVED HEATING ELEMENTS

BACKGROUND OF THE INVENTION

1. Field of the Invention

This invention relates to thermal ink jet printing devices and, more particularly, to thermal ink jet printheads having bubble generating heating elements or transducers with improved performance.

2. Description of the Prior Art

Though thermal ink jet printing may be either a continuous stream type or a drop-on-demand type, its most common type is that of drop-on-demand. As a drop-on-demand type device, it uses thermal energy to produce a vapor bubble in an ink-filled channel to expel a droplet. A thermal energy generator or heating element, usually a resistor, is located in the channels near the nozzle a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

The environment of the heating element during the droplet ejection operation consists of high temperatures, frequency related thermal stress, a large electrical field, and a significant cavitational stress. The mechanical stress, produced by the collapsing vapor bubble, in the passivation layer over the heating elements are severe enough to result in stress fracture and, in conjunction with ionic inks, erosion/corrosion attack of the passivation material. The cumulative damage and materials removal of the passivation layer and heating elements result in hot spot formation and heater failure. Accordingly, a protective layer, such as tantalum (Ta) is generally provided over the heating elements or resistors and their passivation layer to reduce the cavitational damage.

In the side shooter configuration of a thermal ink jet printhead, the flow direction of the ink to the nozzle and the trajectory of the expelled droplet are the same and this direction is parallel to the surface of the resistors. This is the printhead configuration of the present invention, though the improved heating elements of the present invention are equally helpful in the roof shooter configuration, wherein the droplets are expelled in a direction perpendicular to the heating elements from nozzles generally aligned thereover.

In prior art heating elements, there is as much as 100° C. temperature difference between the temperature at the center and at the edges of a 45 to 50 micrometer wide heating element. The temperature also falls off at the ends in the longitudinal direction (i.e., along the length of the ink channel) because the heating element length in this direction is significantly longer than the active length. By active length it is meant that portion of the resistive material that is used to form the bubble and is roughly that portion underneath the exposed tantalum protective layer or pit, if a thick film layer is used as disclosed in U.S. Pat. No. 4,638,337 to Torpey et al (refer to FIG. 3). Some energy is wasted in this non-active portion of electrode interface, and this wastage may be reduced by shortening the length of the heating element in that direction. However, the problem of non-uniformity in the transverse direction remains, even for a shortened heating element. At the threshold energy input, only the center of the heating element surface reaches the nucleation temperature. The edges of the heating element are significantly at lower temperatures. The bubble formation in that situation is not strong and stable enough to produce useful ink drops. Therefore, it is necessary to increase the energy input to the heating element, so that a major portion of the heater surface exceeds the nucleation temperature, and the printhead is able to produce and expel large and fast ink droplets. Experience has shown that as much as 20% energy increase over the threshold energy is required to achieve this objective. Because of the larger energy input to the heating element, the temperature in the control region of the heating element far exceeds the nucleation temperature. Referring to FIG. 5, this energy increase is necessary to produce a large enough bubble to expel a droplet of appropriate size. Thus, the heating elements must be driven to higher temperatures than would be necessary if the transverse temperature profile were uniform. The drop size dependence on energy is probably a result of the non-uniform transverse temperature across the width of the heating element.

The ink jet industry has recognized that the operating lifetime of the ink jet printhead is directly related to the number of cycles or bubbles generated and collapsed that the heating element can endure before failure. Various approaches and heating element constructions are disclosed in the following patents, though none heretofore have solved the problem of non-uniform temperature distribution across the width of the heating element in a direction transverse to the droplet trajectory.

U.S. Pat. No. 4,725,859 to Shibata et al discloses an ink jet recording head which comprises an electro-thermal transducer having a heat generating resistance layer and a pair of electrodes connected to the layer, so that a heat generating section is provided between the electrodes. The electrodes are formed thinner in the vicinity of the heat generating section for the purpose of eliminating a thinning of the passivation layer at the corners of the step produced by the confronting edges of the electrodes adjacent the heat generating section of the resistance layer.

U.S. Pat. No. 4,567,493 and U.S. Pat. No. 4,686,544, both to Ikeda et al disclose an ink jet recording head having an electro-thermal transducer comprising a pair of electrodes connected to a resistance layer to define a heat generating region. U.S. Pat. No. 4,567,493 discloses a passivation layer 208 that prevents shorting of electrodes, and a second passivation layer 209 prevents ink penetration and enhances liquid resistivity of the electrode passivation layers. Third layer 210 protects the heat generation region against cavitational forces. U.S. Pat. No. 4,686,544 discloses a common return electrode that covers the entire surface of the substrate 206 and overlying insulative layer 207 containing the plurality of transducers with openings therein for the placement of the heat generating regions.

U.S. Pat. No. 4,339,762 to Shirato et al discloses an ink jet recording head wherein the heat generating portion of the transducer has a structure such that the degree of heat supplied is different from position to position on the heating surface for the purpose of changing the volume of the momentarily produced bubbles to achieve gradation in printed information.

U.S. Pat. No. 4,370,668 to Hara et al discloses an ink jet recording process which uses an electro-thermal transducer having a structure laminated on a substrate including a resistive layer and addressing electrodes. A signal voltage is applied to the resistive layer while a second voltage of about half the signal voltage is applied to a tantalum protective layer electrically isolated from the transducer by a passivation layer. Such an arrangement elevates the dielectric breakdown voltage and increases the recording head lifetime.

U.S. Pat. No. 4,532,530 to Hawkins discloses a thermal ink jet printhead having heating elements produced from doped polycrystalline silicon. Glass mesas thermally isolate the active portion of the heating element from the silicon supporting substrate and from electrode connecting points.

SUMMARY OF THE INVENTION

It is the object of the present invention to provide a thermal ink jet printhead having heating elements with a substantially uniform temperature across its width and in a direction transverse to the trajectory of expelled ink droplets.

It is another object of the invention to provide a thermal ink jet printhead having heating elements with a structure which provides lower resistance at its opposing edges than at its center portion.

In the present invention, an improved thermal ink jet printhead has a plurality of heating elements in ink channels selectively addressable by electrical signals to eject ink droplets from nozzles located at one end of the ink channels on demand. The heating elements each have a passivated layer of resistive material that has non-uniform sheet resistance in a direction transverse to the direction of ink in the channels. The non-uniform sheet resistance provides a substantially uniform temperature across the width of the resistive layer, so that the power required to eject a droplet is reduced and the droplet size dependence on electrical signal energy is eliminated.

A more complete understanding of the present invention can be obtained by considering the following detailed description in conjunction with the accompanying drawings wherein like parts have the same index numerals.

DESCRIPTION OF THE PREFERRED EMBODIMENT

Figure 1:
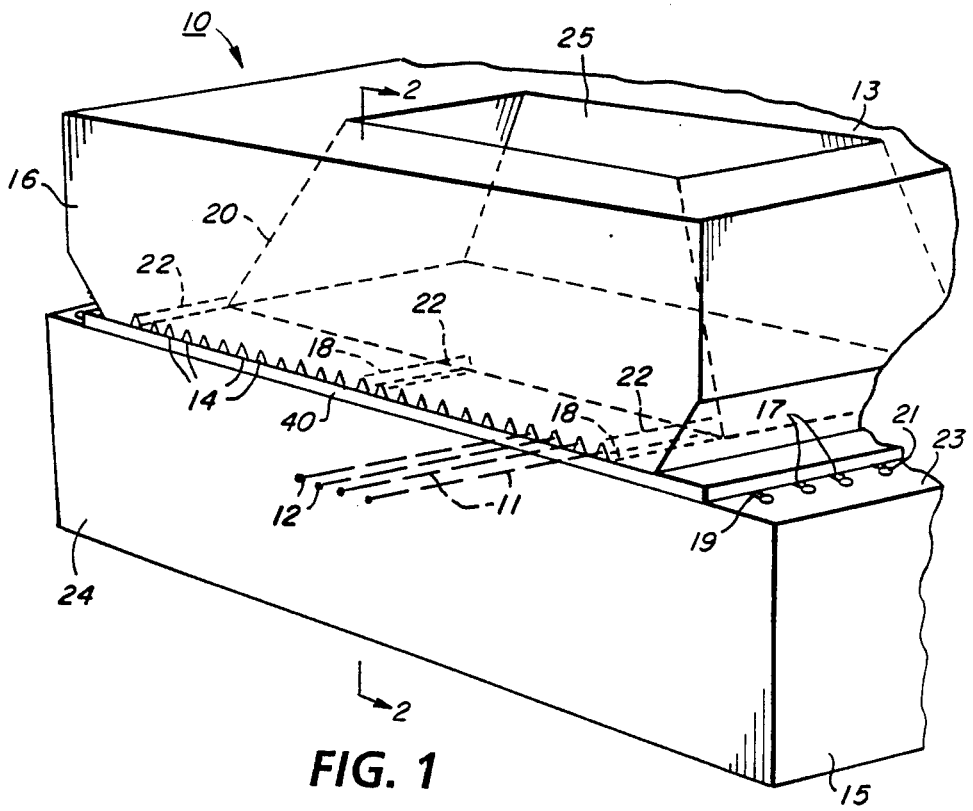
FIG. 1 is a schematic, partial isometric view of a printhead containing the improved heating elements of the present invention.

In FIG. 1, a schematic representation of a thermal ink jet printhead 10 containing the improved heating elements 18 of the present invention is partially shown in isometric view with the ink droplet trajectories 11 shown in dashed line for droplets 12 emitted from orifices or nozzles 14 on demand. The printhead comprises a channel plate or substrate 13 permanently bonded to heater plate or substrate 15 with a thick film insulative layer 40 sandwiched therebetween, as disclosed in U.S. Pat. No. 4,638,337 to Torpey et al. The material of the channel plate is silicon and the heater plate 15 may be any dielectric or semiconductive material. If a semiconductive material is used for the heater plate, then an insulative layer (not shown) must be used between it and the electrodes 17 and 19, as discussed later. Preferably, the material of both substrates is silicon because of their low cost, bulk manufacturing capability as disclosed Re. in U.S. Pat. No. 32,572 to Hawkins.

One surface of channel plate 13 contains an etched through recess 20 with open bottom 25, shown in dashed lines, which, when mated to the heater plate 15 forms an ink reservoir or manifold. A plurality of identical parallel grooves 22, shown in dashed lines and having triangular cross sections, are etched in the same surface of the channel plate with one of the ends thereof penetrating edge 16 of the channel plate. This edge 16 is also referred to as nozzle face. The other ends of the grooves open into the recess or manifold 20. When the channel plate and heater plate are mated, the groove penetrations through edge 16 produce the nozzles 14 and the grooves 22 serve as ink channels which connect the manifold with the nozzles. The open bottom 25 in the channel plate provides inlet means for maintaining a supply of ink in the manifold from an ink supply source (not shown).

Figure 2:
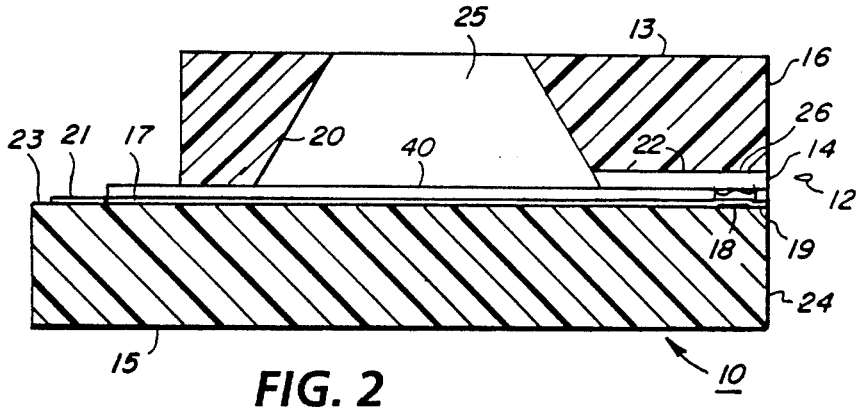
FIG. 2 is a cross-sectional view of the printhead as viewed along view line 2—2 of FIG. 1.

FIG. 2 is an enlarged cross-sectional view of the printhead as viewed along view line 2—2 of FIG. 1, showing the heating elements 18, individual addressing electrode 17 with terminal 21, and common return electrode 19. The heating elements have resistive layers patterned on the surface 23 of the heater plate 15, one for each ink channel in a manner described by the above-mentioned patent to Hawkins et al, and then the electrode 17 and common return electrode 19 are deposited thereon. The addressing electrodes and return electrode connected to respective terminals 21 near the edges of the heater plate, except for the edge 24 which is coplanar with the channel plate edge 16 containing the nozzles 14 (see FIG. 1). The grounded common return 19, better seen in FIG. 1, necessarily spaces the heating element 18 from the heater plate edge 24 and thus the nozzles 14. The addressing electrodes and heating elements are both within the ink channels, requiring pin hole free passivation wherever the ink may contact them. The thick film layer 40 provides the added protection necessary to improve the passivation integrity and eliminates the concern about pin holes in the passivation layer 28 (shown in FIG. 3). The terminals 21 are used for wire bonding (not shown) the addressing electrodes and common return to a voltage supply adapted to selectively address the heating elements with an electrical pulse representing digitized data, each pulse ejecting a droplet from the printhead and propelling it along trajectories 11 to a recording medium (not shown) by the formation, growth, and collapse of bubble 26. Opening 25 enables means for maintaining the manifold 20 full of ink.

As disclosed in U.S. Pat. No. 4,532,530 to Hawkins, the operating sequence of the bubble jet systems starts with an electrical pulse through the resistive heating element in the ink filled channel. In order for the printer to function properly, heat transferred from the heating element to the ink must be of sufficient magnitude to superheat the ink far above its normal boiling point. For water-based inks, the temperature for bubble nucleation is around 280° C. Once nucleated, the bubble or water vapor thermally isolates the ink from the heating element and no further heat can be applied to the ink. The bubble expands until all the heat stored in the ink in excess of the normal boiling point diffuses away or is used to convert liquid to vapor. The expansion of the bubble 26 forces a droplet 12 of ink out of the nozzle 14. Once the excess heat is removed, the bubble collapses on the heating element creating a severe cavitational stress which results in stress fracture over operating time. The heating element at this point is no longer being heated because the electrical pulse has passed and concurrently with the bubble collapse, the droplet is propelled at a high rate of speed in the direction towards a recording medium. The entire bubble formation/collapse sequence occurs in about 30 microseconds. The channel can be refired after 100–500 microseconds minimum dwell time to enable the channel to be refilled and to enable the dynamic refilling factors to become somewhat dampened.

Figure 3:
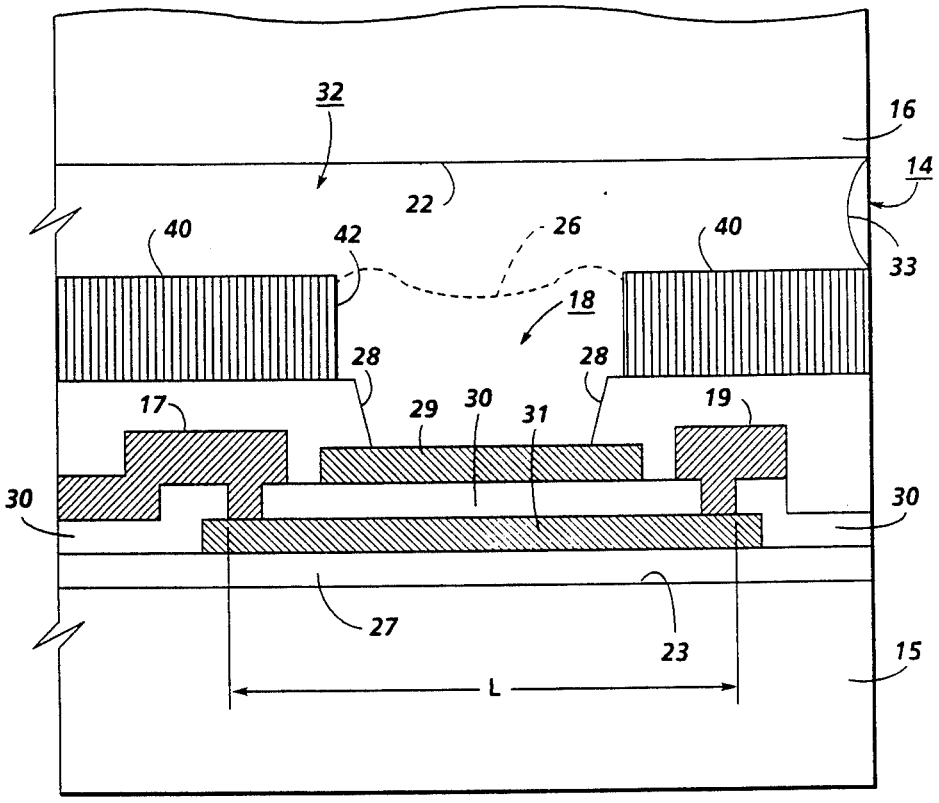
FIG. 3 is an enlarged, cross-sectional view of the improved heating element in the same orientation as shown in FIG. 2.

An enlarged schematical cross-sectional view of the heating element of FIG. 2 is shown in FIG. 3, with a vapor bubble 26 thereon shown in dashed line. The heater plate 15 may be insulative or semiconductive, such as silicon. If the heater plate is silicon, then an insulative, underglaze layer 27 such as silicon dioxide or silicon nitride is formed on the surface 23 thereof prior to forming the heating elements 18. Next, insulative layer 30, such as, for example, silicon nitride, is formed on vias patterned therein for electrical contact of the subsequently formed addressing electrodes 17, and common return 19. Passivation layer 28 and thick film layer 40 insulate the electrodes and common return from the ink 32, which is usually a water-based ink. The thick film layer 40 is etched to provide pits 42 in order to expose the heating elements to ink 32. As disclosed in U.S. Pat. No. 4,638,337 to Torpey et al, the pit recesses the heating elements to enable increased droplet velocities without blowout of the bubble and consequent ingestion of air. Meniscus 33 together with a slight negative ink supply pressure keeps the ink from weeping from the nozzles. Though the heating element may comprise any resistive material 31, doped polysilicon is a popular heating element material, and, if used, is generally insulated from a cavitation protecting layer 29, such as tantalum, by insulative layer 30. A bubble 26, shown in dashed line, is generated upon the selective application of an electrical pulse to the resistive layer 31, which ejects a droplet as discussed above.

Figure 4:
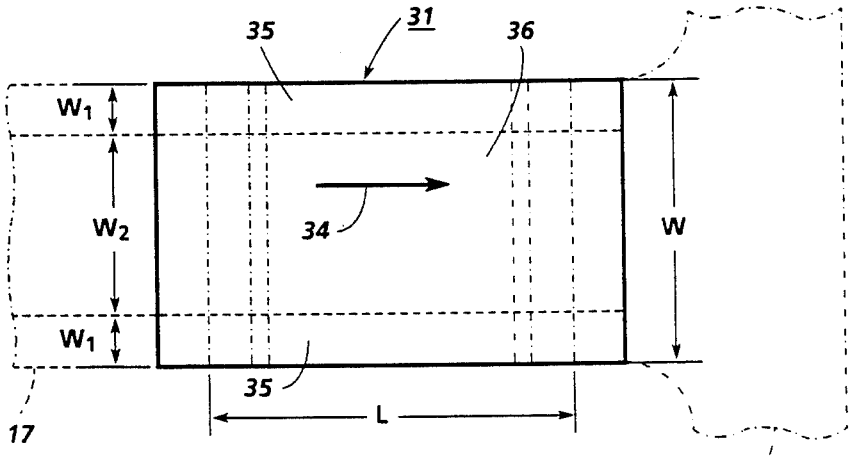
FIG. 4 is an enlarged, plan view of the resistive layer of the improved heating element with the connecting electrodes shown in phantom line.

FIG. 4 is a top view of the layer of resistive material 31, as shown in FIG. 3, with the addressing electrode 17 and common return 19 shown in phantom line. The direction of ink flow and droplet trajectory (refer to FIG. 1) is along the length L of the resistive material as depicted by arrow 34. The power distribution across the width W of the resistive material can be varied by introducing non-uniform resistivity in the resistive material. Because the sheet resistance of polysilicon can be modified by controlling the doping or by implantation, it is possible to split the heating element or resistive material therein, either physically or by implantation, into smaller sub-sections in such a way that the combined effect of all of the sections produce a uniform temperature.

In the preferred embodiment, only three strips of power distributions in the resistance material are sufficient to provide uniform temperature over the width W of the surface of the heating element. Two equal edge strips 35, identified by dashed lines, must carry significantly more power density than the wider central strip 36. This means the sheet resistance of the central strip 36 has to be higher than that of the sheet resistance in the outer opposing edge strips 35. For a resistive material layer having a length (L) of 175 micrometers and a width (W) of 45 micrometers, the edge strip widths ($W_1$) will be 5 micrometers and the width of the central strip 36 will be 35 micrometers. This specific configuration for the resistive material with a thickness of 0.5 to 1.0 micrometers necessitates a sheet resistance for the central strip 36 of 1.5 times that of the sheet resistance of the edge strips 35, so that the outer edge strips carry 50% more power density than the wider central strip 36. This provides a substantially uniform temperature across the width of the heating element at the tantalum layer 29 and ink 32 interface when the electrical pulse is applied to the heating element.

Figure 5:
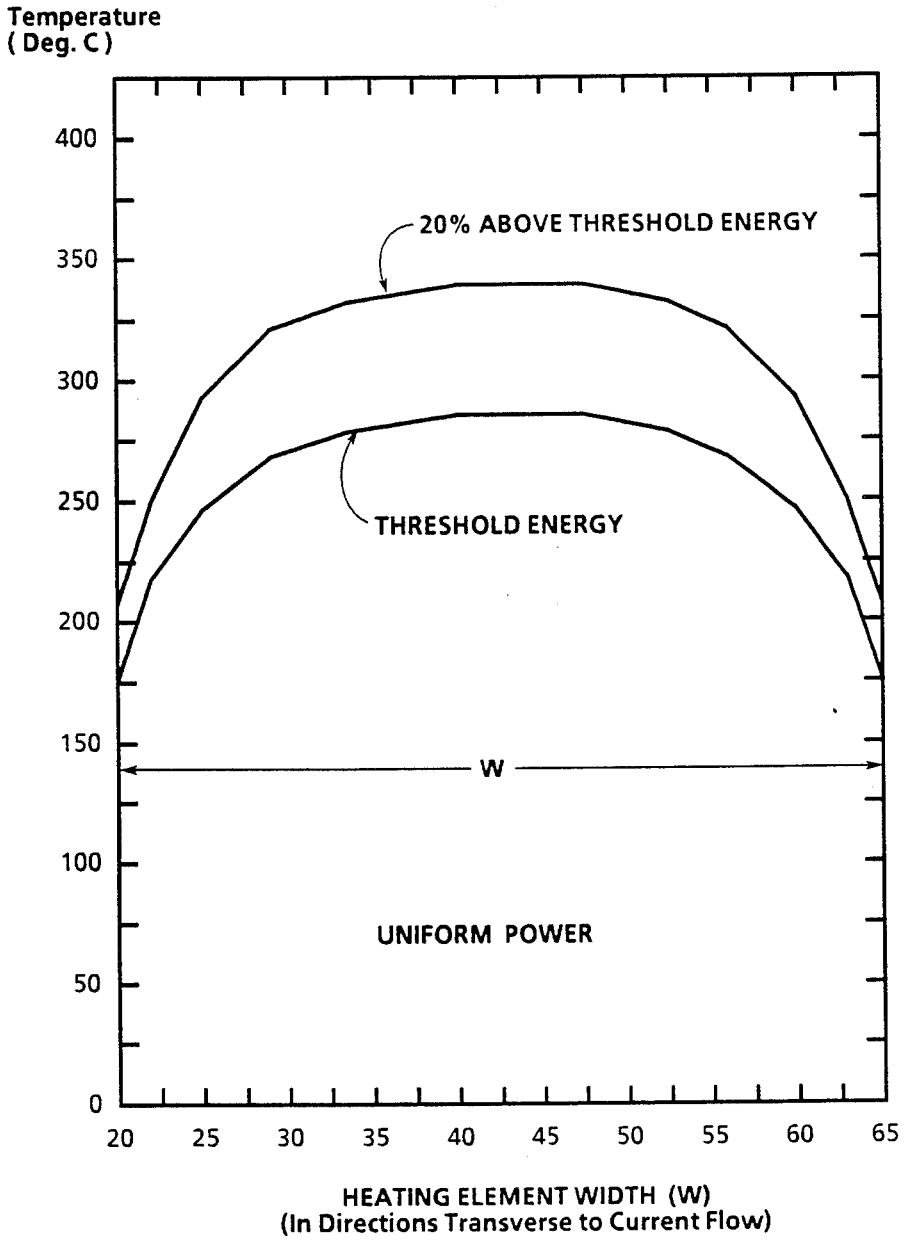
FIG. 5 PRIOR ART
FIG. 5 is a plot of the temperature across the width of a prior art heating element.
Figure 6:
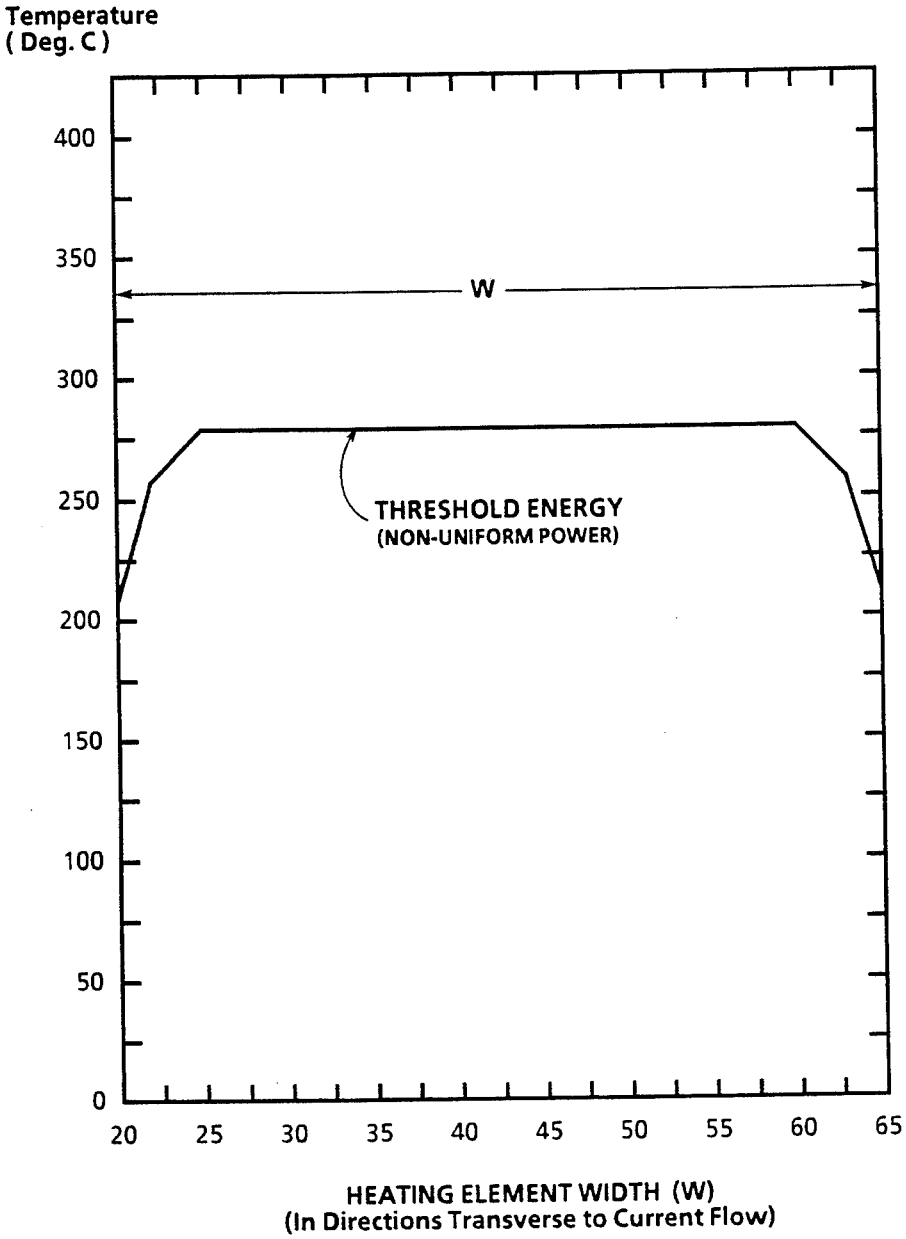
FIG. 6 is a plot of the temperature across the width of the heating element of the present invention.

FIG. 5 is a plot of the temperature distribution across the width of a typical prior art heating element at the tantalum-ink interface when the heating element is supplied with a uniform power distribution; i.e., the resistive material has a uniform sheet resistance. Threshold temperature plot or profile across the width of the heating element surface which interfaces with the ink in a direction transverse to the flow of electrical current is shown which clearly depicts a small area at the required nucleation temperature. To provide a larger area of the heating element at the nucleation temperature of 280° C., the surface of the heating element must be heated to a value of 20% above the threshold temperature. The maximum temperature in the center of the 20% over threshold is above 358° C. For a more energy efficient heating element, the temperature must be minimized. Also, lower temperatures means longer heating element lifetimes. FIG. 6 is a similar plot of the temperature distribution across the width of the heating element of the present invention at the tantalum-ink interface when it is supplied with a non-uniform power distribution according to the configuration in FIG. 4.

Figure 7:
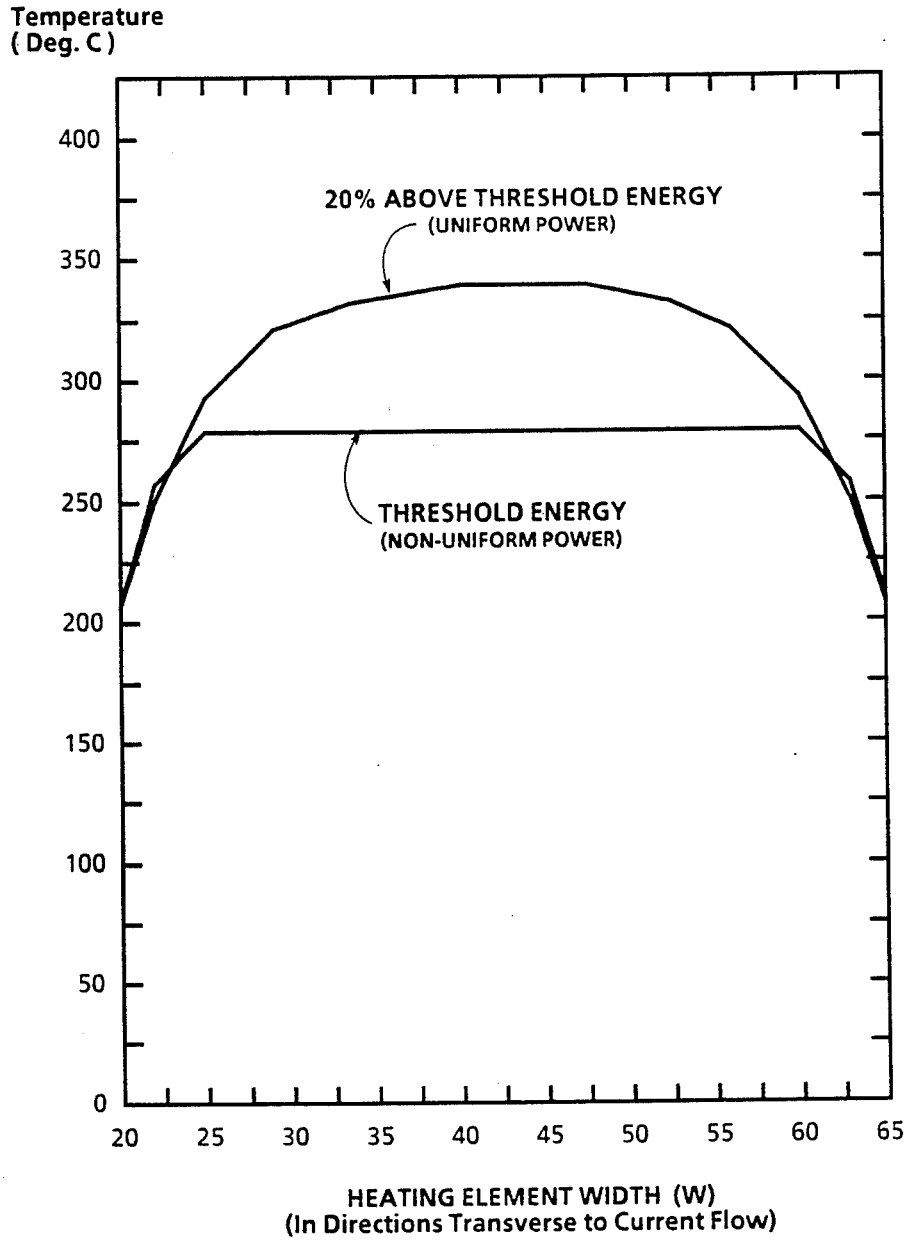
FIG. 7 is a plot comparing the temperatures across the width of a prior art heating element and a heating element of the present invention.

From FIG. 6, it is seen that a significantly large section of the tantalum surface is at a uniform temperature which will result in a larger drop volume and larger velocity, because a much greater portion is at the required nucleation temperature of 280° C. Comparing FIGS. 5 and 6, the threshold energy is slightly more than 5% in the distributed power situation, but then it is not necessary to have a 20% overdrive as is the case with prior art heating elements, thereby resulting in a 5 to 15% saving in the energy consumption. This comparison of temperature profiles produced by the bubble generating current pulses in prior art heating elements and the heating element of this invention is shown in FIG. 7. In addition, all other advantages mentioned earlier will be realized. Thus, a smaller heating element size may provide the droplet volume currently obtained with the larger heating element.

Many modifications and variations are apparent from the foregoing description of the invention, including other distributions that also produce uniform temperature on the heating element (tantalum) surface, and all such modifications and variations are intended to be within the scope of the present invention.

I claim:

1. An improved thermal ink jet printhead having a plurality of droplet emitting nozzles, heating elements and addressing electrodes, and ink flow directing channels, the channels communicating with an ink manifold and with the nozzles, each heating element having an active region which contacts the ink and the addressing electrodes connecting to each heating element, so that selective application of electrical signals to the addressing electrodes cause the heating elements to eject and propel ink droplets from the nozzles to a recording medium, wherein the improvement comprises:

said heating elements having a resistive material layer that has a uniform thickness of at least 0.5 μm and has non-uniform sheet resistance in a direction transverse to the direction of current flow therethrough which is produced by the electrical signals, the non-uniform sheet resistance being of such predetermined value and location to provide a substantially uniform temperature profile along the transverse direction to the current flow, at a location near a center section of the active region of the heating element, so that the energy consumption required by the heating elements to eject a droplet is reduced and the temperature excursions of the heating element is minimized, thereby extending the life of heating elements.

2. The improved printhead of claim 1, wherein the resistive material layer is doped polysilicon having a thickness of 0.5 to 1.0 μm, and wherein the non-uniform sheet resistance of each heating element comprises lower sheet resistance along parallel strips at its opposing outer edges than remaining strip at its center portion, the opposing outer edges being in a direction parallel to the current flow therethrough.

3. The improved printhead of claim 2, wherein the ink flow directing channels are parallel with each other and connect to the ink manifold at one end and to the nozzles at the other end, so that the ink flow in the channels is parallel to both the surface of the heating elements and the direction of current flow through the heating elements.

4. The improved printhead of claim 3, wherein the printhead further comprises two substrates aligned and bonded together, the heating elements and addressing electrodes being patterned on a surface of one of the substrates, the substrate surface containing the heating elements and electrodes being mated to a surface of the other substrate which contains recesses that will serve as manifold and channels after being mated, one end of the channels being open to serve as the nozzles; and wherein the heating elements comprise a resistive material layer and cavitational protective layer which interfaces with the ink and an insulative layer which separates the resistive material layer from the cavitational protective layer.

5. The improved printhead of claim 4, wherein the resistive material layer has a length of 175 μm, the width of the outer opposing strips is 5 μm, and wherein the resistance of the center strip of the layer of resistive material is 1.5 times that of the outer edge strips, so that the outer edge strips carry 50% more power density.

6. The improved printhead of claim 2, wherein the sheet resistance of the center strip portion of the heating elements is 1.5 times that of the outer edge strips, so that the outer edge strips carry about 50% more power density.

7. The improved printhead of claim 1, wherein the center portion and the opposing outer portions of the resistive material layer are three physically separate, parallel subsections which are contiguously combined in such a way that the combination of the subsections produce a uniform temperature.

* * * * *